United States Patent [19]

McIntosh

[11] 4,423,821

[45] Jan. 3, 1984

[54] STRESS FAILURE RESISTANT CONTAINER CAP

[75] Inventor: James McIntosh, Montclair, N.J.

[73] Assignee: Mack-Wayne Plastics Company, Wayne, N.J.

[21] Appl. No.: 304,834

[22] Filed: Sep. 23, 1981

[51] Int. Cl.[3] ..... B65D 41/04

[52] U.S. Cl. ..... 215/329; 215/350

[58] Field of Search ..... 215/260, 271, 329, 342, 215/344, 350, 349, 341

[56] References Cited

U.S. PATENT DOCUMENTS

| | | | |
|---|---|---|---|
| 3,435,976 | 4/1969 | Owens | 215/329 |
| 4,128,184 | 12/1978 | Northup | 215/350 X |
| 4,322,011 | 3/1982 | Mumford | 215/341 X |

FOREIGN PATENT DOCUMENTS

| | | | |
|---|---|---|---|
| 977196 | 12/1964 | United Kingdom | 215/341 |

*Primary Examiner*—Donald F. Norton

*Attorney, Agent, or Firm*—Eugene E. Renz, Jr.

[57] ABSTRACT

A stress failure resistant container cap for a threaded neck container in the nature of a carboy, such as large acid carboys, wherein the containers are usually large and heavy and closure caps therefor are also extremely heavy in structure. Carboys, for example, are sufficiently large that users sometimes over-tighten the cap using a wrench or similar tool. This can result in cap failures due to stress cracking due to the high torque applied to the cap. The high torque applied to the cap, and its coaction with the threads of the neck, when high or excessive torques are applied, tend to apply a strain in the corner juncture between the cap top and neck thereof. This can, and frequently has, resulted in cracking of the cap material. The strain is applied by a tendency to apply a bending force to the cap at the juncture corner.

This invention teaches a construction of two-piece cap having a full large radius in the top corner whereby the top of the cap can bend when excess pressure is applied with a spring like action imparted to the cap. The cap, per se, is molded of high density or polypropylene material, or other suitable material and has interfitted therewith, and forming a component of the two-piece cap structure, a molded and assembled polyethylene cap liner fitment.

The composite cap can be used in the absence of additional liners where polyethylene caps are considered suitable, or it is possible to add a separate liner for users desiring caps lined with other lining materials.

8 Claims, 4 Drawing Figures

STRESS FAILURE RESISTANT CONTAINER CAP

TECHNICAL FIELD

The invention relates generally to containers and cap closures therefor. More specifically, the container is of a large and heavy type, such as large acid carboys which necessitate very heavy cap structures. The carboy neck is provided with external threads and the cap is internally threaded for coaction therebetween. Carboys are sufficiently large that it is relatively easy for users to over-tighten the caps with a wrench or similar mechanism. This has resulted in cap failures due to stress cracking resulting from the high torque applied on the cap.

The invention, accordingly, is principally directed to caps for use with large containers such as large acid carboys and the like, and which incorporates a two-piece cap which has a full, large radius in the top corner of the cap so that the top of the cap can bend when high or excess torque pressure is applied to the cap, the cap bending in the nature of an elastic bend, and thus eliminating application of excess strains on the usually plastic material of the cap in the corner thereof.

The present invention is primarily directed to a cap structure which can be composite and include a mated liner and wherein a spring or resilient bending of the cap can occur at the corner in a manner to reduce strain applied to the material at the corner and, thus, diminish stress failure of the cap through cracking. The problem of failure by cracking in caps of the nature of the present one is accentuated by the fact that some acids will damage plastic material used for the caps.

BACKGROUND OF THE INVENTION

Caps which are used on large containers, such as large acid carboys, are normally molded from a plastic material, and utilized in conjunction with a cap liner as applied to a threaded neck on the carboy. The caps contain internal threading.

Acid carboys and the like are known to be large and heavy, and caps used therefor are also of extremely heavy construction. The large size of the container and the coactive cap sometimes result in a tendency for users to over-tighten the caps by means of a wrench or other mechanism. Prior constructions of caps for this use usually are of a molded plastic structure, wherein the cap top meets the internally threaded cap skirt at a corner juncture point which can closely approximate a 90° angle. For use with acid carboys, a liner is normally used with the cap.

With such prior known and used caps, when the cap is over-tightened, a resulting force is applied between the container neck upper end at a point inwardly disposed from the juncture corner, or point. This spaced inner force application results in creation of heavy strains due to a lever arm type of strain, or force application. The application in this sense tends to make the cap bend, putting a heavy strain on the plastic material in the corner which, in time, has been found to crack the cap at this point.

Principally, the present invention is directed to a cap structure for use with large and heavy containers such as threaded neck acid carboys and the like, wherein the configuration and structure tends to eliminate the application of the applied strain on the plastic material in the cap corner by providing the ability to elastically bend or stretch under applied forces in the nature of a spring.

The preferred construction consists of a two-piece cap having a full, large radius in the top corner of the cap at the juncture between the top of the cap and its skirt. The inner portion of the cap has a peripheral rib which engages the container opening and is spaced inwardly from the skirt. The rib bridges the full large radius in the top corner of the cap and a domed-shaped center portion. This configuration and construction permits flexure of the dome and corner portions and lateral elastic yielding of the top portion when high or excess pressures are applied, resulting from heavy torque forces applied to the cap structure, the forces resulting from the coaction of the threads of the container neck and cap.

Other objects and advantages of the present invention will become readily apparent to those skilled in the art from the following detailed description, wherein there is shown and described a preferred embodiment of the invention, simply by way of illustration of a currently preferred and contemplated mode for carrying out the invention. As will be realized, the invention is susceptible of other and specific embodiments, and details are capable of modification in various, obvious respects, all without departing from the invention. Accordingly, the drawings and description are to be regarded merely as illustrative in nature, and not as restrictive.

BRIEF DESCRIPTION OF THE DRAWINGS

The accompanying drawing illustrates both prior art constructions and a preferred embodiment of the present invention and, when taken together with the description, serve to explain the principles and structure of the invention.

In the drawings.

DETAILED DESCRIPTION OF DRAWINGS

Figure 2:
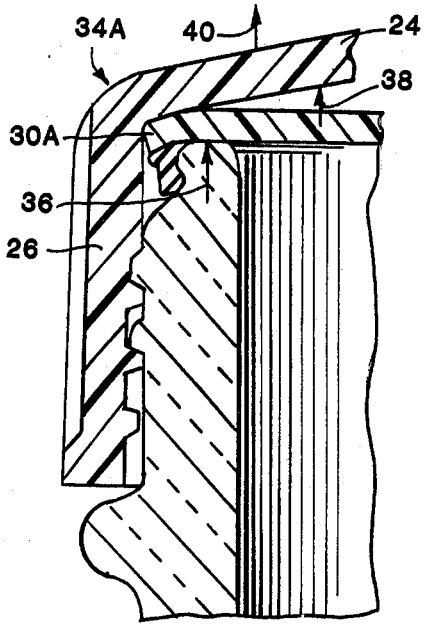
FIG. 2 ( PRIOR ART )
FIG. 2 is a view similar to FIG. 1, wherein the cap has been over-tightened by application of an excess torque thereto, and disclosing the result of the application of bending forces, or strains, to the cap structure.
Figure 3:
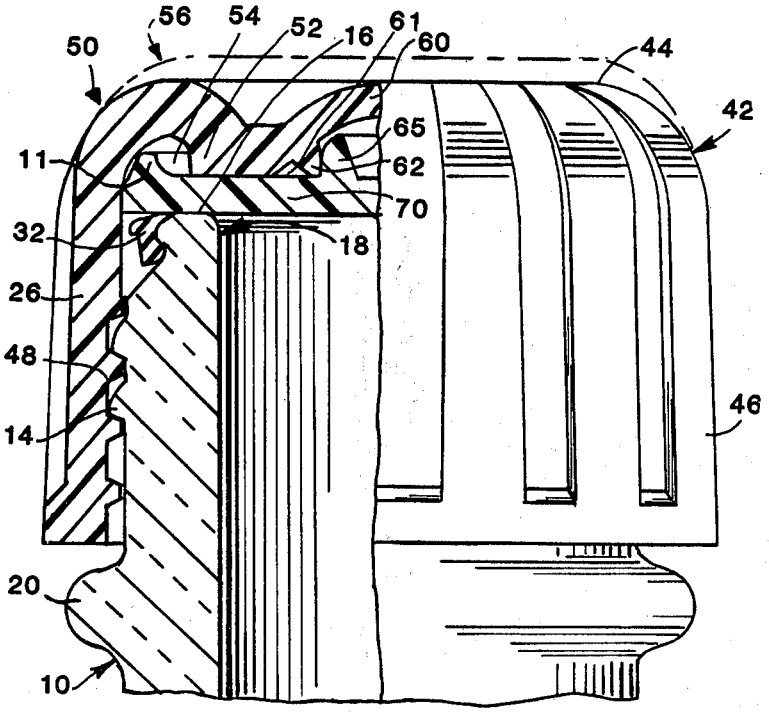
FIG. 3 is an elevational view, of the cap of the present construction, a part thereof being broken away, and structure shown in section for clarity and elucidation of the present invention, including a cap and coactive liner mated therewith.
Figure 4:
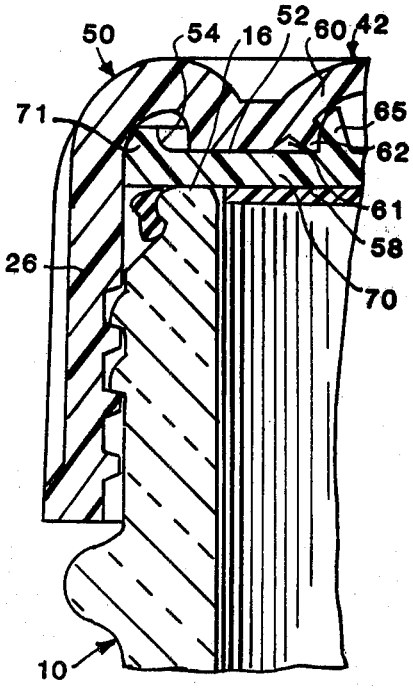
FIG. 4 is a fragmentary, sectional view of a modified form of the cap having an additional liner affixed therein.

The invention, and the principles thereof, are shown in the drawing, in FIGS. 3 and 4 thereof. A structure utilized in the prior art, the failure of which led to and resulted in the present invention, is shown in FIGS. 1 and 2.

Figure 1:
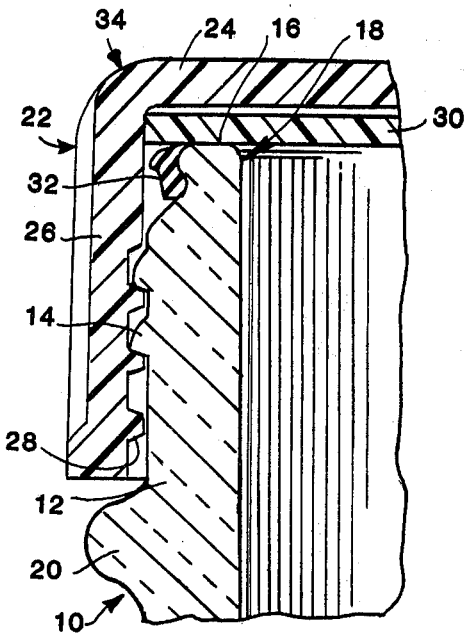
FIG. 1 ( PRIOR ART )
FIG. 1 is a fragmentary, sectional view through a threaded neck of a container, such as an acid carboy, and disclosing a cap construction and liner as known in the prior art, and wherein the cap is applied with normal torqueing or torque forces.

Referring initially to FIGS. 1 and 2 of the drawings, there is shown, fragmentarily and in section, a container, such as an acid carboy container, generally designated 10, having an externally threaded neck 12 thereon. Such carboys are usually constructed of glass material and are large and heavy. The threads on the neck are specifically designated 14 and the neck terminates in a top edge or end 16, which peripherally extends and defines the access opening 18 of the carboy. A finish, or peripheral bead, 20 is provided as per usual.

A cap structure, generally designated 22, is formed in a usual, known manner, with a top 24 and a depending skirt 26 having internal threads 28 adapted for coaction with threads 14 on the carboy neck. A liner insert 30 is provided in the cap interior proximate top 24 in a usual manner, as also with a drip-less fitment 32, which coacts with and extends peripherally around the top end or edge 16 of the carboy neck about access opening 18.

The cap 22 is normally formed or molded from a plastic material, and for use with acid carboys, is of a very heavy thickness and construction. The liner 30 and drip-less fitment 32 are likewise usually formed from plastic material, but of a more resilient nature, all being well known in the art.

In FIG. 1, a normal application of the cap to the carboy is disclosed. By application of a normal and adequate torque on cap 22, the access opening 18 is closed and sealed by coaction of the liner insert 30. It is to be noted that in this normal affixation of the cap on the carboy, the top 24 and depending skirt 26 are joined at a juncture point or corner indicated at 34, and the angle formed between the top and skirt is approximately 90°.

Due to the fact that the carboys, as used, are large and heavy, and the caps are extremely heavy, it has been found, in the past, that users sometimes over-tighten the caps by use of a wrench or other tool. This condition is shown in FIG. 2. When a high or excessive torque is applied to the cap, coaction between the threads of the neck and cap give a resulting force in the direction, and at the position indicated by arrow 36. It is seen that this excessive torque, and the resultant force at 36, has a tendency or result to compress and bend the outer end of liner 30, as indicated at 30A. This action also puts a heavy strain on the plastic material of the cap, as indicated by arrow 38. In effect, the spacing inwardly of this additional strain from the corner of the cap acts as a lever arm, and creates the strain indicated by arrow 38, in a manner tending to bend the top upwardly, as indicated by arrow 40. A comparison of FIG. 2 with FIG. 1 shows that the angle between top 24 and skirt 26, at their joinder or juncture point 34A, is greater than 90°. This additional strain and tendency to bend the cap material can, in time, crack or cause a failure of the cap material. Even though users or customers for the cap are cautioned against over-tightening of the caps, such over-torquing has in the past occurred and has resulted in stress failure of the container cap.

The present invention overcomes this problem with prior art caps, and reference is especially made to FIG. 3 of the drawings. Here, the carboy 10 is the same as in FIG. 1, including the neck 12, threads 14, top edge or end 16, dripless fitment 32 and access opening 18. The cap of the invention, as shown in FIG. 3, and indicated at 42, is formed of a plastic material known in the art and similar to the cap of FIG. 1. The cap 42 includes a top 44 and a depending skirt at 46. The depending skirt is internally threaded as shown at 48. The cap is preferably formed of high density or polypropylene material. The configuration of the cap as molded includes a full, large radius at the top corner 50 as distinguished from the right angle juncture 34 of FIG. 1. The cap construction 42 is, in fact, a two-piece cap, the interior face of the top 44 being configured as indicated at 52, with a circumferentially depending portion or rib 59, spaced inwardly from the skirt 46, which coacts on its outer side with a groove 54 in the upper surface of a polyethylene liner fitment 70. The rib 59 bridges the top corner 50 and a domed center portion 60. The inner side of the rib 59 has a relief groove 61 defining a circumferentially extending downwardly depending lip 62. The liner fitment 70 has an outer upwardly projecting flange 71 which defines the groove 54 and an inner upwardly projecting flange 65 radially spaced from flange 71 which cooperates with the cap lip 62 to hold the liner in the cap. This results in a molded and assembled polyethylene cap and liner fitment combination. Excessive torque applied to the cap 42 and liner 70 causes the cap rib 52 to press against the liner 70 which abuts the container neck causing an elastic yielding of the domed center section 60 and the corner section 50 in an upward direction as indicated by broken line 56 thereby preventing stress cracking of the cap. This action, due to the present construction, permits the top of the cap to bend when high or excessive pressure is applied by over-torquing of the cap, sort of like a spring. Due to this action, the increase in strain or stress forces are taken up by the bending of the cap material due to the large radius in the top corner of the cap, and it has been found that cap failure due to stress cracking under high torque conditions is overcome. This elastic or spring design and the elimination of the inner corner of the cap, as shown in FIG. 1, provides a substantial improvement and solution to the cracking problem. While the cap is of more elaborate construction, and therefore probable additional cost and care in molding is required, the solution to a dangerous and possibly expensive problem is now taught in the present invention.

Some forms of caps, as shown in FIG. 3, can be used, as shown, with the mated liner 56. It is possible to add a separate, or second liner, shown at 58, appropriately attached within the cap, and which can consist of lining material other than polyethylene, as above referred to. Some users prefer this type, FIG. 4.

The remainder of the structure shown in FIG. 4 is identical with the structure of FIG. 3.

Accordingly, the present invention overcomes problems existing with prior art cap structures, as utilized with large acid carboys or containers, where over excessive torque has been applied to the container cap and which heretofore has resulted in stress failure or cracking at the corner of the cap. When considering especially the material to be contained by the carboy, this is a very substantial contribution.

While a very specific and particular cap configuration and construction has been shown in the drawings, minor variations therein will be obvious to those skilled in the art without departing from the spirit of the invention. Such obvious changes or modifications are considered to be within the scope of the inventive concept as expressed herein, and as claimed hereinafter.

I claim:

1. A stress failure resistant cap for a threaded neck container having a discharge opening therein, said cap being made of a resilient material and including;

a top portion having a dome-shaped center section and a circumferentially depending annular rib which bridges the dome-shaped center section and outer corner portion and engages the container adjacent the discharge opening when the cap is applied, a skirt depending from said top portion and having threads which cooperate with the threads on the container neck as the cap is applied, a circumferential corner portion of arcuate cross section having a full large radius located at the juncture between said rib and said skirt, whereby excessive tightening pressure applied to said cap causes flexure of said dome and corner portions and lateral elastic yielding of said top portion thereby preventing stress cracking of said cap top portion.

2. A cap as claimed in claim 1 wherein said dome-shaped center section is upwardly extending and of generally semi-spherical configuration.

3. A cap as claimed in claim 1 wherein said cap is molded from high density plastic material.

4. A cap as claimed in claim 3 wherein said plastic material consists of polypropylene.

5. A cap as claimed in claim 1, said threaded neck container comprising an acid carboy container and said cap being of a heavy construction and comprised of a plastic material.

6. A cap and liner for a container having a discharge opening, said cap being made of resilient material and including;

a top portion having a dome-shaped center section and a circumferentially extending, depending keystone rib having a relief groove defining a circumferentially extending, downwardly depending lip, a skirt depending from said top portion having internal threads which cooperate with the threads on the container neck when the cap is applied, a corner portion of arcuate cross section located at the juncture of said rib and said dependent skirt, a liner fitment confined within said cap top portion having inner and outer circumferentially extending, upwardly projecting flanges radially spaced from one another, said inner flange adapted to cooperate with said lip to hold said liner in said cap, said rib engaging in the annular space between said inner and outer flanges, whereby excessive tightening torque applied to said cap and liner on said container causes said cap rib to press against said liner which abuts said container neck thereby elastically yielding said dome section and said corner section in an upwardly direction to prevent stress cracking of said cap.

7. A cap as claimed in claim 6, said liner fitment and said cap consisting of polypropylene plastic material.

8. A cap as claimed in claim 6 and further including a second separate liner, operatively attached to the undersurface of said liner fitment and consisting of a material other than polypropylene.

* * * * *